US005462433A

United States Patent [19]

Benck et al.

[11] Patent Number: 5,462,433

[45] **Date of Patent: * Oct. 31, 1995**

[54] DEVICE FOR BLOWING PREHEATED AIR INTO A SHAFT FURNACE

[75] Inventors: Jean Benck, Dudelange; Pierre Mailliet, Redange/Attert, both of Luxembourg

[73] Assignee: Paul Wurth S.A., Luxembourg

[ * ] Notice: The portion of the term of this patent subsequent to May 11, 2010, has been disclaimed.

[21] Appl. No.: 212,229

[22] Filed: Mar. 14, 1994

[30] Foreign Application Priority Data

Mar. 31, 1993 [LU] Luxembourg ..... 88241

[51] Int. Cl.[6] ..... F27D 1/08

[52] U.S. Cl. ..... 432/99; 110/182.5

[58] Field of Search ..... 432/99, 96, 95, 432/102; 110/182.5; 122/6.5

[56] References Cited

U.S. PATENT DOCUMENTS

| | | | |
|---|---|---|---|
| 3,766,868 | 10/1973 | Mahr | 110/182.5 |
| 4,023,832 | 5/1977 | Legille | 110/182.5 |
| 4,027,605 | 6/1977 | Legille | 110/182.5 |
| 5,209,657 | 5/1993 | Benck et al. | 432/99 |

FOREIGN PATENT DOCUMENTS

| | | |
|---|---|---|
| 0484720A1 | 5/1992 | European Pat. Off. . |
| 2039327 | 1/1971 | France . |
| 2134390 | 12/1972 | France . |
| 2285582 | 4/1976 | France . |
| 2218331C2 | 11/1972 | Germany . |
| 7325087 | 1/1973 | Germany . |

*Primary Examiner*—Andrew M. Dolinar
*Attorney, Agent, or Firm*—Fishman, Dionne & Cantor

[57] ABSTRACT

The present invention relates to a device for blowing preheated air into a shaft furnace, comprising several separate tubular elements, wherein an outer shielding made of steel and an inner lining made of cast refractory concrete are connected in pairs by a ball joint and a compensator. The ball joint includes a convex pivot which is integral with a first tubular element and which can pivot in a concave dish integral with a second tubular element. At least the convex pivot of the ball joint comprises a profiled refractory brick anchored in the inner refractory lining made of cast refractory concrete.

9 Claims, 4 Drawing Sheets

DEVICE FOR BLOWING PREHEATED AIR INTO A SHAFT FURNACE

BACKGROUND OF THE INVENTION

This invention relates generally to devices for blowing preheated air into a shaft furnace. More particularly, this invention relates to a device for blowing preheated air into a shaft furnace consisting of several separate tubular elements comprising an outer steel shielding and an inner lining made of cast refractory concrete, connected in pairs by a ball joint and a compensator.

Preheated air blowing devices, more generally known under the name "tuyere stock", are subject to problems of mobility and leaktightness. In fact, as a consequence of the high temperature of the preheated air (temperature on the order of 1200° C. or more) and the high temperature prevailing inside the furnace, the wall of the furnace, as well as the supply pipe and the tuyere stock are exposed to thermal expansions and deformations causing significant relative displacements between the supply pipe and the wall of the furnace. It is therefore necessary for the tuyere stock to be capable of compensating for these relative displacements while at the same time, avoiding leaks of gas or preheated air.

In order to satisfy these requirements, U.S. Pat. No. 3,766,868 provides a tuyere stock of the type described hereinabove. This tuyere stock has subsequently been improved by the design of universal ball joints of the type described in document DE-C2-2218331. The joints of this tuyere stock make it possible to compensate for all the relative movements between the supply pipe and the wall of the furnace. The leaktightness at the joints is ensured by bellows compensators, while the mechanical stability is ensured, for example by associated universal linkages, at the two universal joints, at the two opposite ends of the central tubular element.

By far, the most greatly stressed and least resilient location is always situated at the joints. In fact, the mobility of the pivot with respect to its dish often leads to rubbing of refractory concrete on refractory concrete. As a result, the refractory concrete at the tip of the pivot can be damaged and splinters can possibly be detached. Thus, in view of the large variations in temperature, micro-cracks can form at certain places, which cause detrimental circulation and turbulence.

U.S. Pat. No. 5,209,657 proposes extension of the metal shielding forming the sheath of the pivot as far as the diametrical base of the convex pivot. This invention greatly improves the mechanical stability of the convex pivots and allows better sliding of the convex pivot in the concave dish of the adjacent segment.

However, in the long term, the refractory steel forming the tip of the pivot oxidizes, and the entire sheath of the pivot must be replaced.

It will be appreciated that there remains an urgent need to develop and provide a new and improved system of joints that is much more resistant both to the thermal and mechanical stresses to which such joints are subject to in the field.

SUMMARY OF THE INVENTION

The above-discussed and other problems and deficiencies of the prior art are overcome or alleviated by the device for blowing preheated air into a shaft furnace of the present invention. In accordance with the present invention, a device for blowing preheated air into a shaft furnace is presented where at the very least, the convex pivot of the ball joint comprises a profiled refractory brick anchored in the inner refractory concrete lining.

The manufacture of the convex pivot of profiled refractory brick makes it possible to obtain a better compromise between mechanical stability and thermal stability. In fact, these profiled refractory brick pivots have mechanical stability greater than pivots formed of cast refractory concrete and have thermal stability greater than pivots made of cast refractory concrete provided with a refractory steel protective sheath.

By virtue of the much improved compromise between mechanical stability and thermal stability, the risk of micro-cracks forming and the pivot being degraded is almost nonexistent. Maintenance becomes easier and less expensive.

It is also important to emphasize that better thermal insulation at the pivots can be achieved.

In accordance with a first preferred embodiment of the tuyere stock, the radius of curvature of each ball joint is on the order of magnitude of the external radius of the tubular elements. This small radius of curvature ensures better guidance of the pivots in their dish, allowing retention of the same thickness of the seal during the angular movement.

In accordance with a second preferred embodiment, the refractory steel lining extends up to the convex part of the pivot and terminates in a projecting lip on which the profiled refractory brick bears. The support lip combined with the small radius of curvature makes it possible to guarantee that the bearing forces are always perpendicular to the radius of curvature. In this manner, risks of splinters being detached from the profiled refractory brick are eliminated.

The concave dish may also be formed of profiled refractory brick anchored in the inner lining made of refractory concrete. This makes it possible to prevent the formation of micro-cracks and to improve the thermal insulation at the concave dish of the pivot.

An insulating jacket may, if required, be interposed between the profiled refractory brick and the outer shielding.

The pivot and the tubular element may form a single piece with the refractory lining of the tubular element, or alternatively the pivot may constitute a separate element, mounted on the tubular element and separated from the inner lining of the tubular element by an annular seal.

The shielding of the tubular element and that of the adjacent tube may be connected directly to each other through a compensator, or via a flange or a detachable weld.

A soft refractory seal between the pivot and the dish may be attached partially on the shielding and partially on the edge of the dish. It may also be partially attached in an inner housing of the cylindrical sheath and partially on the refractory. In accordance with another preferred embodiment, it may also be attached partially on the refractory and partially in the housing delimited by the upper part of the sheath and by a ring welded inside the shielding.

The above-discussed and other features and advantages of the present invention will be appreciated and understood by those of ordinary skill in the art from the following detailed discussion and drawings.

BRIEF DESCRIPTION OF THE DRAWINGS

Referring now to the drawings, wherein like elements are numbered alike in the several FIGURES.

DESCRIPTION OF THE PREFERRED EMBODIMENTS

Figure 1:
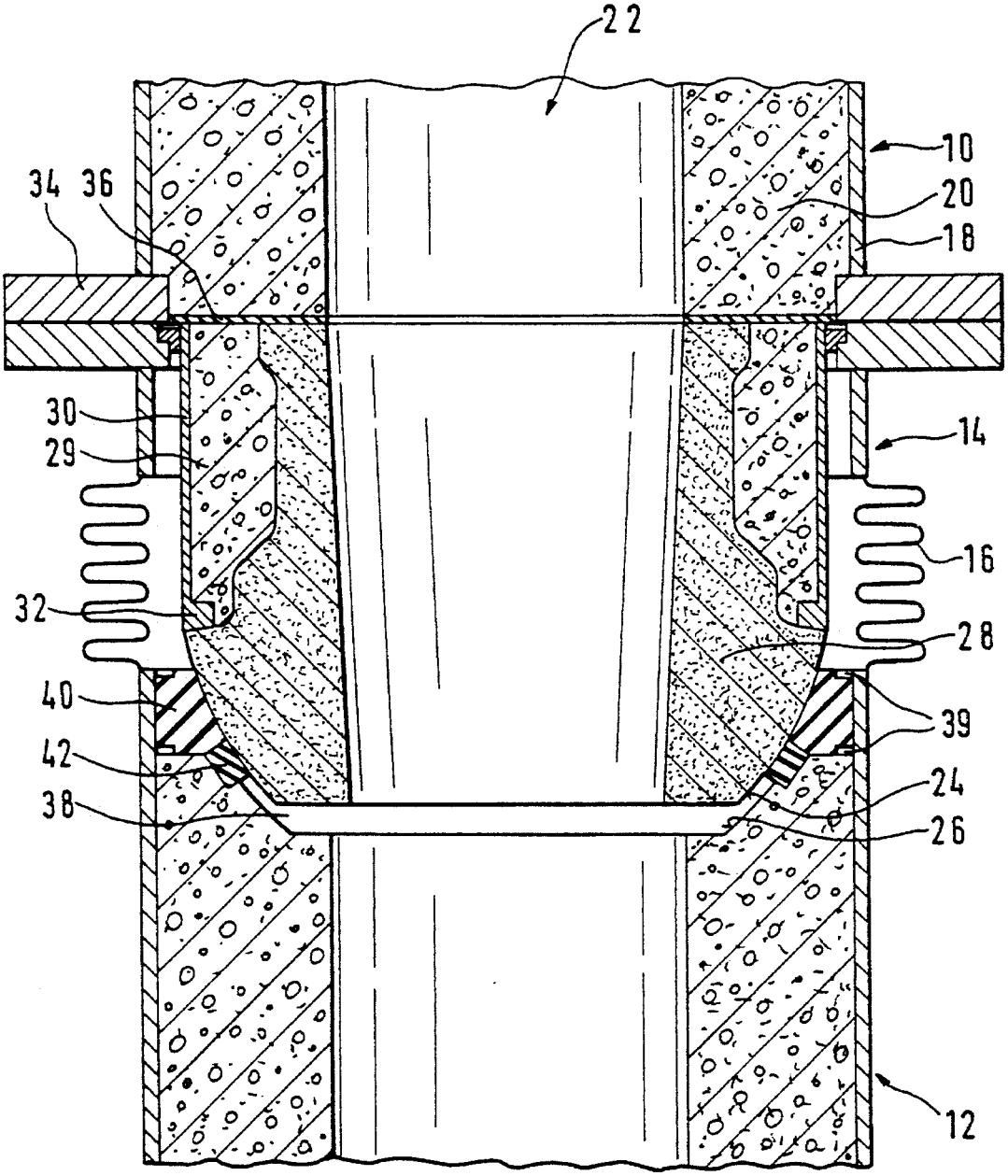
FIG. 1 is an axial cross-sectional view of a ball joint of a tuyere stock whose convex pivot is formed of profiled refractory brick.

Referring first to FIG. 1, the device for blowing preheated air into a shaft furnace is shown generally by the entire FIG. 1. The device of FIG. 1 shows two tubular elements 10, 12 of a tuyere stock which are connected by a ball joint 14 and a bellows compensator 16. The tubular elements 10, 12 comprise an outer shielding 18 made of refractory steel and an inner lining made of cast refractory concrete 20. The hot blast passes through a central slot 22 made in the refractory concrete 20. The joint 14 is formed by a convex pivot 24 and a concave dish 26. The pivot 24 is formed by a profiled refractory brick 28. In accordance with an important feature of this invention, the brick comprises a specially developed annular anchoring surface 29 which makes it possible to fix it solidly in the inner lining made of cast refractory concrete 20.

The convex part of the pivot 24 has a radius of curvature which lies preferably between 0.8 and 1.2 times the external radius of the tubular elements 10, 12. A refractory steel sheath 30 extends up to the convex part of the pivot 24 and terminates in a projecting lip 32 which forms a bearing surface for the brick 28.

The convex pivot 24 is connected to the tubular element 10 by a flange 34 and an annular seal 36. This facilitates mounting and dismounting of the pivot 24.

Between the pivot 24 and the dish 26, a space 38 is made which is rendered leaktight on its periphery by a soft seal 40 fixed to the shielding 18 and by a soft seal 42 which adheres on the external edge of the dish 26. The soft seal 40 is attached in a housing 39 delimited by two tings welded inside the shielding 18.

Figure 2:
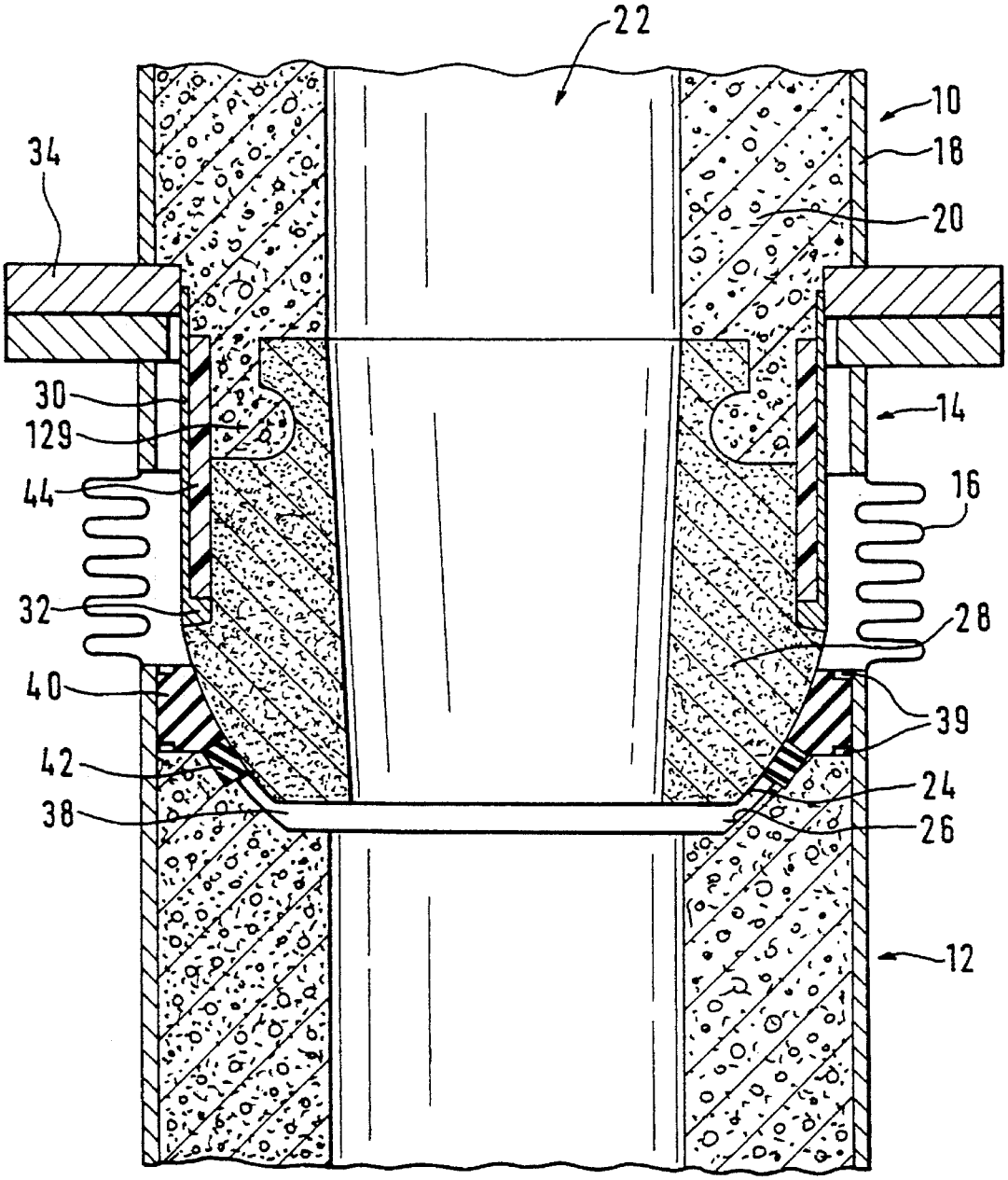
FIG. 2 is an axial cross-sectional view of a ball joint of a tuyere stock whose convex pivot is formed of profiled refractory brick in accordance with a second preferred embodiment of the device of FIG. 1.

FIG. 2 shows a second preferred embodiment of a joint of a tuyere stock. Between the refractory steel sheath 30 and the profiled refractory brick 28, an insulating jacket 44 has been introduced, which ensures better thermal insulation of the convex pivot 24 and of the compensator 16. The anchoring surface 29 of the refractory brick 28 in the inner lining made of cast refractory concrete 20 preferably has a "dovetail" shape. This particular shape of the anchoring surface 129 makes it possible to hold the refractory brick 28 in place and prevent it from moving vertically and horizontally.

Figure 3:
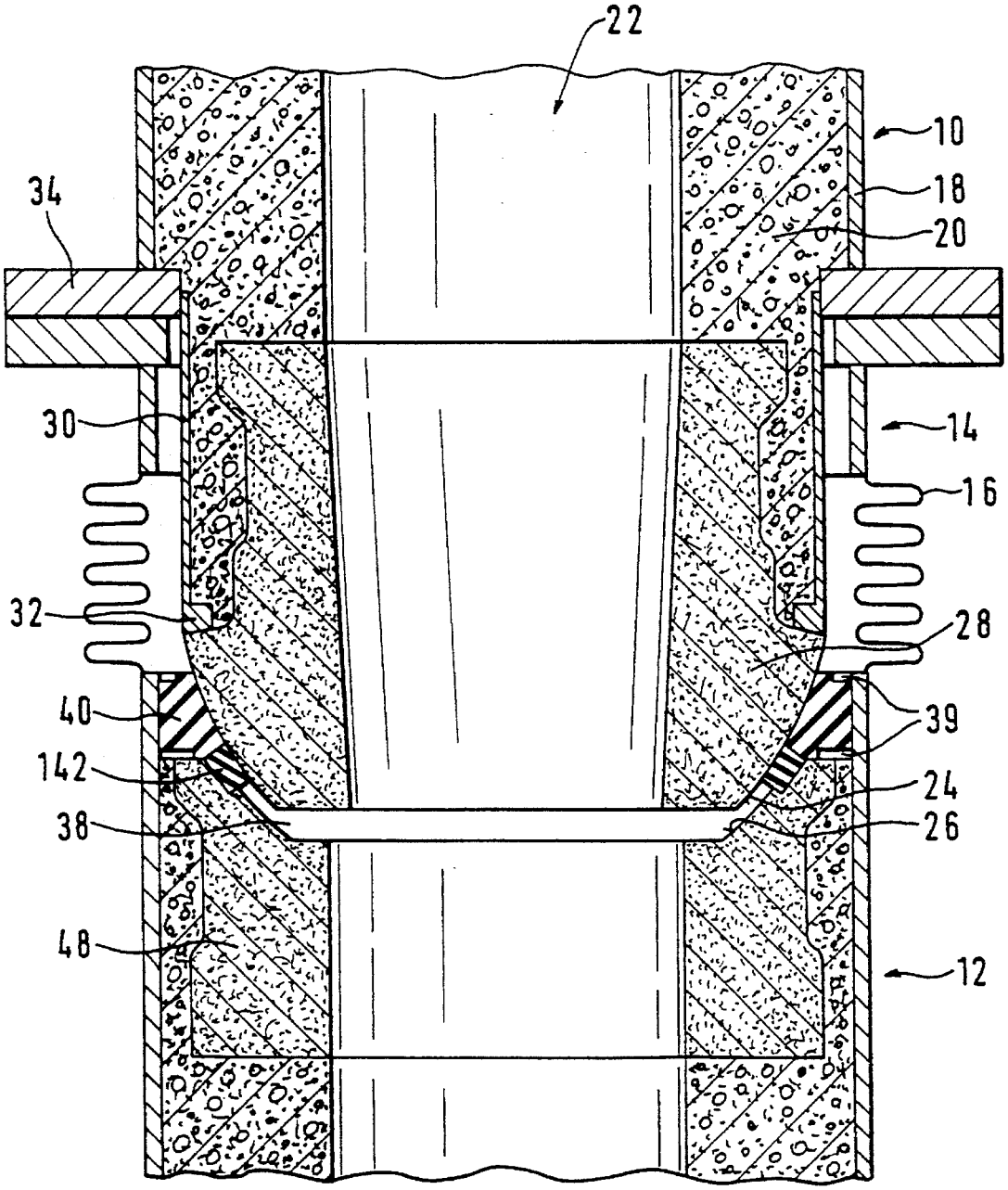
FIG. 3 is an axial cross-sectional view of a ball joint of a tuyere stock whose both convex pivot and convex dish are formed of profiled refractory brick in a third preferred embodiment of the device of FIG. 1.

FIG. 3 represents a third preferred embodiment of the joint of a tuyere stock, in which both the convex pivot 24 and the hollow dish 26 are formed of profiled refractory bricks 28, 48.

One advantage of this embodiment (FIG. 3) is that the formation of micro cracks at the concave dish is eliminated.

A soft seal 142, attached to the refractory brick 48 of the concave dish 26, and the soft seal 40 ensure leaktightness of the space made between the convex pivot 24 and the concave dish 26.

Figure 4:
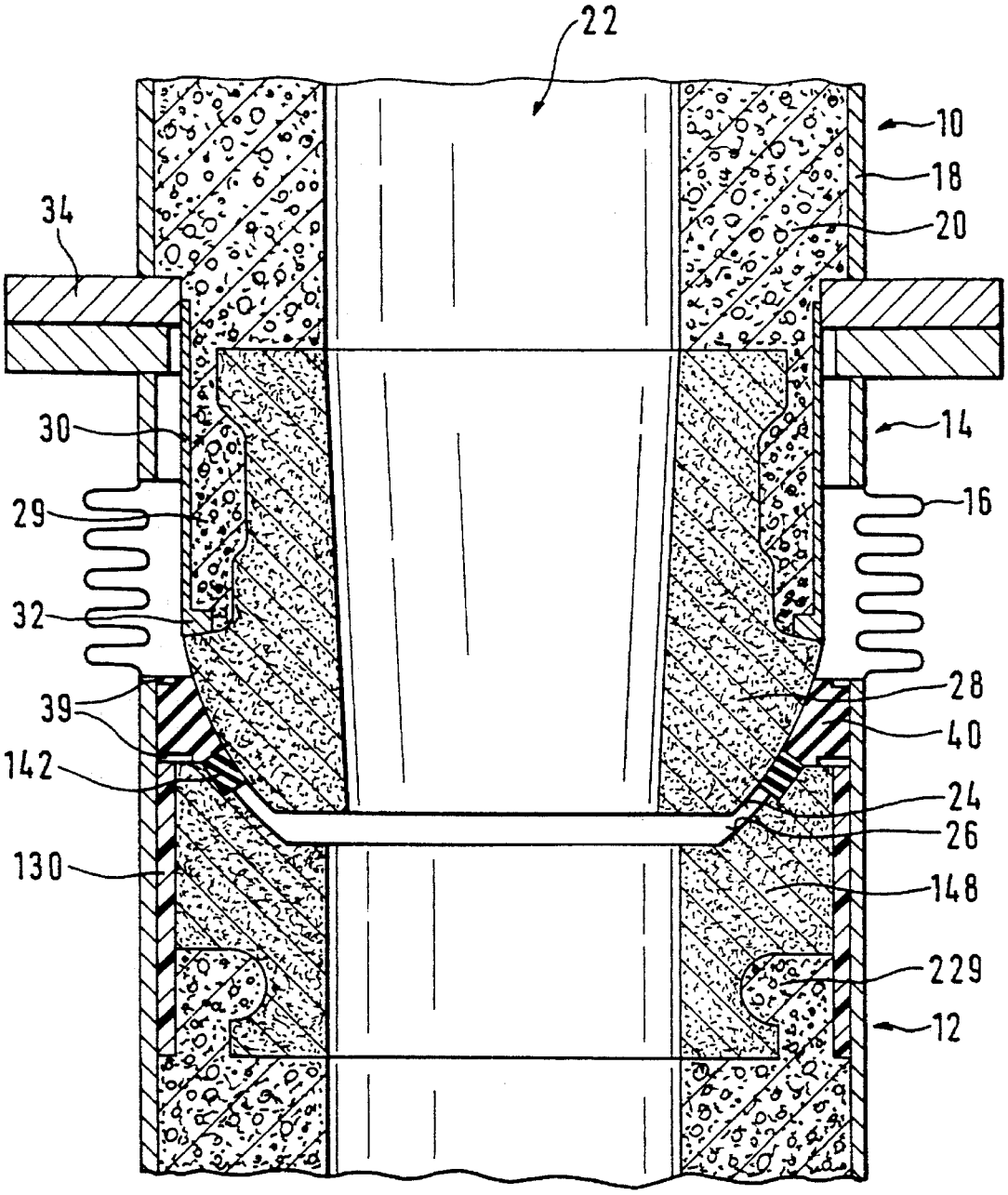
FIG. 4 is an axial cross-sectional view of a ball joint of a tuyere stock in a fourth preferred embodiment of the device of FIG. 1 similar to FIG. 3.

FIG. 4 represents a fourth preferred embodiment of a joint of a tuyere stock in which the convex pivot 24 and the concave dish 26 are formed of profiled refractory brick 28, 148. An insulating jacket 130 is interposed between the refractory steel shielding 18 and the brick 148 in order to improve the thermal insulation.

An anchoring surface 229 of"dovetail" shape holds the brick 148 in the cast refractory concrete lining.

In FIGS. 2, 3 and 4 it will be appreciated that the convex pivot is integral with the tubular element 10.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A device for blowing preheated air into a shaft furnace, comprising a first and second tubular element, each fitted with an outer shielding made of refractory steel and with an inner refractory lining made of cast refractory concrete, the first and second tubular elements being connected by a ball joint and a compensator, and the ball joint including:

a convex pivot which is integral with the first tubular element and which can pivot in a concave dish integral with the second tubular element, wherein at least the convex pivot of the ball joint comprises a profiled refractory brick anchored in the inner refractory lining made of cast refractory concrete.

2. The device of claim 1 wherein a sheath made of refractory steel extends up to the convex part of said pivot and terminates in a projecting lip which forms a bearing surface for the profiled refractory brick.

3. The devices of claim 1 wherein the radius of curvature of the ball joint is of the order of magnitude of the external radius of the two tubular elements.

4. The device of claim 1 wherein the concave dish of said ball joint comprises a profiled refractory brick anchored in the inner refractory lining.

5. The device of claim 1 wherein an insulating jacket is interposed between the refractory brick and the refractory steel sheath.

6. The device of claim 1 wherein the refractory concrete in which the profiled brick is anchored forms a single piece with the refractory lining of the first tubular element.

7. The device of claim 1 wherein the pivot constitutes a separate element mounted on the first tubular element and separated from the inner refractory lining of the first tubular element by an annular seal.

8. The device of claim 1 wherein refractory seals are attached on the shielding of the second tubular element and an edge of the concave dish.

9. The device of claim 1 wherein a refractory seal is partially attached in a housing inside the second tubular element and partially on at least one of the refractory members.

* * * * *